US005564953A

United States Patent [19]

Endo et al.

[11] Patent Number: 5,564,953

[45] Date of Patent: Oct. 15, 1996

[54] DIVIDED-TYPE MULTI-POLE CONNECTOR

[75] Inventors: Takayoshi Endo; Masayuki Yamamoto, both of Shizuoka, Japan

[73] Assignee: Yazaki Corporation, Tokyo, Japan

[21] Appl. No.: 306,317

[22] Filed: Sep. 15, 1994

[30] Foreign Application Priority Data

Sep. 17, 1993 [JP] Japan ..... 5-253693

[51] Int. Cl.[6] ..... H01R 13/502

[52] U.S. Cl. ..... 439/701; 439/903

[58] Field of Search ..... 439/686, 677, 439/680, 695, 701, 690, 691, 692, 693, 694, 695, 595, 903

[56] References Cited

U.S. PATENT DOCUMENTS

| | | | |
|---|---|---|---|
| 4,927,388 | 5/1990 | Gutter | 439/903 |
| 5,139,447 | 8/1992 | Yoneda et al. | 439/595 |
| 5,312,268 | 5/1994 | Sumida | 439/701 |
| 5,344,347 | 9/1994 | Inoue et al. | 439/701 |
| 5,378,173 | 1/1995 | Hashizawa | 439/701 |

FOREIGN PATENT DOCUMENTS

| | | |
|---|---|---|
| 61-166483 | 10/1986 | Japan . |
| 62-145671 | 6/1987 | Japan . |
| 633075 | 1/1988 | Japan . |
| 494278 | 8/1992 | Japan . |

*Primary Examiner*—Hien D. Vu

*Attorney, Agent, or Firm*—Sughrue, Mion, Zinn Macpeak & Seas

[57] ABSTRACT

A plurality of kinds of multi-pole sub-connectors are provided with retaining means for retaining them on a frame, and provisionally-retaining projections. If an erroneous insertion is not encountered, the multi-pole sub-connectors are fitted in the frame, and are retained relative thereto, and thus are integrally connected together to provide a first connector. A second connector (i.e., a mating connector) to be connected to this first connector is provided with provisionally-retaining arms each of which forces a corresponding one of the multi-pole sub-connectors from the frame if this corresponding sub-connector is incompletely retained on the frame.

4 Claims, 4 Drawing Sheets

DIVIDED-TYPE MULTI-POLE CONNECTOR

BACKGROUND OF THE INVENTION

1. Field of the invention

This invention relates to a divided-type multi-pole connector in which a plurality of kinds of connectors are mounted in a single frame.

2. Related Art

As is well known, an automobile is equipped with various kinds of lamps, wipers, a fuel indicator, a speedometer and so on, and these various parts are connected by a wire harness to an electrical box serving as a socket. In this case, if connector terminals are provided separately for the various kinds of parts, there would arise various problems such as an increased frequency of fitting of the connector terminals, and therefore there has been used a divided-type multi-pole connector, also called a multiple connector.

FIG. 7 shows one example of a conventional multiple connector. One housing 1 comprises a plurality of sub-housing portions 5A and 5B connected together by a frame portion 6. Female connector terminals (not shown) are provided in the sub-housing portions 5A and 5B.

The other housing 2 also comprises a plurality of sub-housing portions 7A, 7B and 7C connected together by a frame portion 8. Female connector terminals (not shown) are provided in the sub-housing portions 7A, 7B and 7C, and male connector terminals (not shown) are provided in the sub-housing portion 7B. The two housings 1 and 2 are tied together by tightening a bolt 3 relative to a nut 4.

For assembling a wire harness, sub-portions for dividing the wire harness are arranged, and these sub-portions are assembled independently of each other. After this assembling operation is finished, the separate sub-housing portion 5A is fitted in the frame portion 6 to be combined with the other sub-housing 5B, thereby forming the one housing 1. Also, the separate sub-housing 7C is fitted in the frame portion 8 to be combined with the other sub-housing portions 7A and 7B, thereby forming the other housing 2. Then, these housings are supplied to a production line for automobiles.

In the multiple connector of the above construction, the sub-housing portions 5A and 5B are integrally combined together to form the one housing 1, and the sub-housing portions 7A to 7C are integrally combined together to form the other housing 2. Therefore, in the production line for automobiles, the fitting operation for the multi-pole connector can be carried out by effecting one tightening operation between the bolt 3 and the nut 4.

In the multiple connector of the above construction, when the sub-connectors 5A and 5B are to be attached to the frame 6, and also when the sub-connectors 7A, 7B and 7C are to be attached to the frame 8, these sub-connectors are retained by frame lances or projections (not shown). However, if the sub-connector is in an incompletely-retained condition, the tightening of the bolt is carried out, with the sub-connector not completely fitted in the frame, in which case the connection between the connectors is incomplete. Namely, the above multiple connector is not provided with any means for confirming the retaining of the sub-connectors on the frame, and therefore the connector has been transferred to a subsequent process step, overlooking such incomplete retaining.

The above multiple connector is disclosed in Japanese Utility Model Unexamined Publication No. 4-94278, and various connector constructions are also disclosed in Japanese Utility Model Unexamined Publication Nos. 61-166483 and 63-3075.

SUMMARY OF THE INVENTION

It is an object of this invention to provide a divided-type multi-pole connector of such a construction that when any of a plurality of multi-pole sub-connectors retained in a frame suffers from incomplete retaining, this incomplete retaining can be detected when the connector is to be connected to a mating connector.

The above object of the present invention has been achieved by a divided-type multi-pole connector wherein a first connector, having a plurality of multi-pole sub-connectors fitted in a frame, is inserted into a second connector to make an electrical connection therebetween, wherein the plurality of multi-pole sub-connectors are provided with retaining means for retaining them on the frame, and provisionally-retaining projections for being provisionally retained relative to the second connector; and the second connector is provided with provisionally-retaining arms for abutment respectively with the provisionally-retaining projections, each of the provisionally-retaining arms forcing a corresponding one of the plurality of multi-pole sub-connectors out of the frame if the corresponding sub-connector is incompletely retained on the frame.

In the divided-type multi-pole connector of the present invention, the plurality of kinds of multi-pole sub-connectors are provided with the retaining means for retaining them on the frame. If an incomplete insertion is not encountered, the multi-pole sub-connectors are fitted in the frame, and are retained relative thereto, and are integrally connected together. The second connector (i.e.,the mating connector) to be connected to the first connector of the above construction is provided with the provisionally-retaining arms each of which forces a corresponding one of the multi-pole sub-connectors from the frame if this corresponding sub-connector is incompletely retained on the frame. Therefore, if an improper retaining condition is encountered in the first connector, this improper retaining can be positively detected, and the first connector, suffering form such improper retaining, is prevented from being connected to the second connector.

DETAILED DESCRIPTION OF THE PREFERRED EMBODIMENTS

Figure 1:
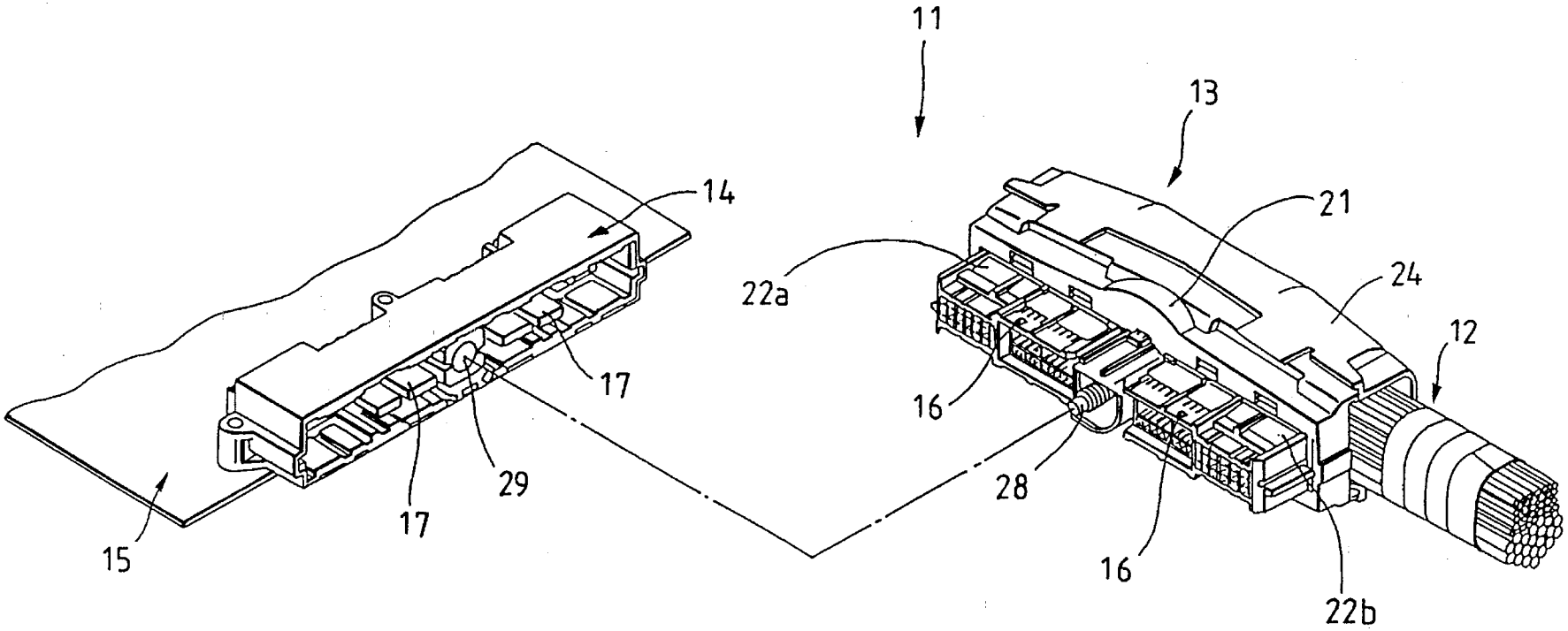
FIG. 1 is a perspective view showing one preferred embodiment of a divided-type multi-pole connector of the present invention.
Figure 2:
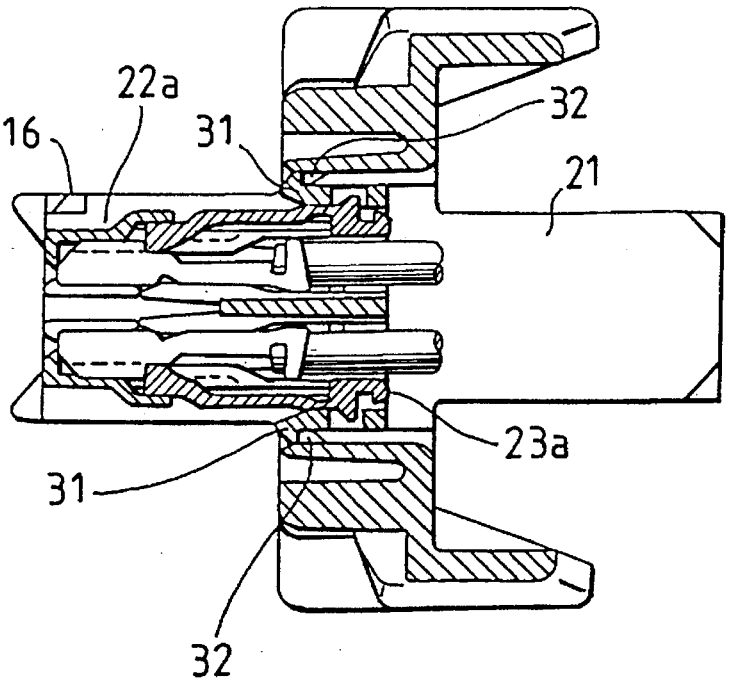
FIG. 2 is a cross-sectional view showing a condition in which a multi-pole sub-connector is retained on a frame.
Figure 3:
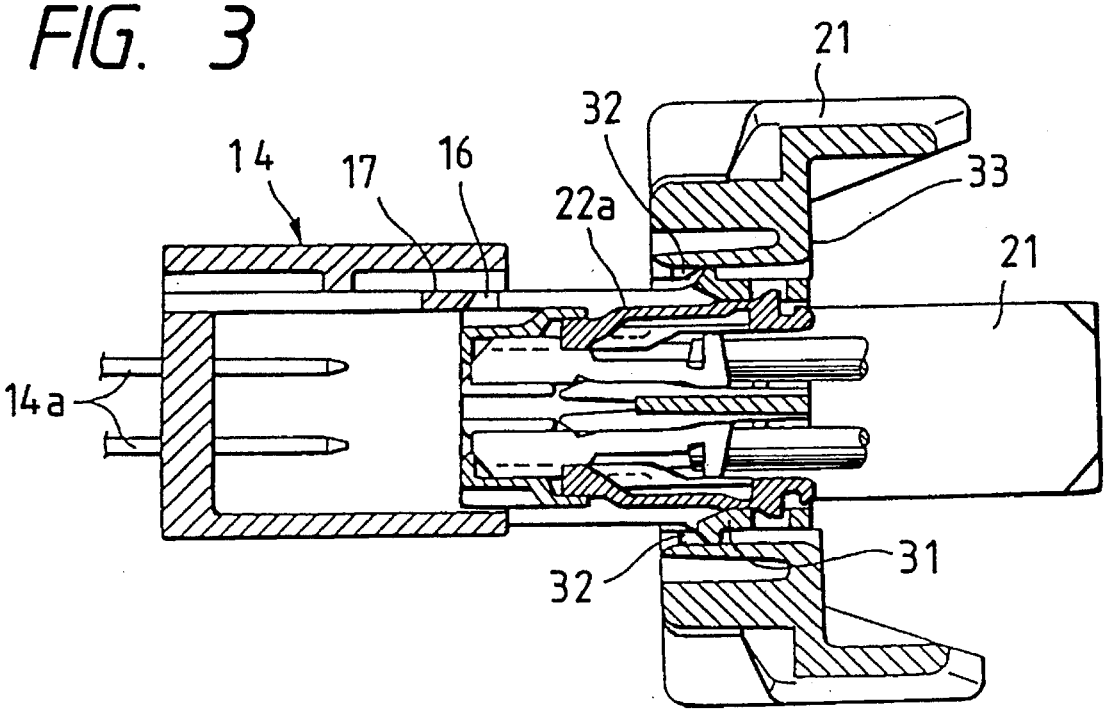
FIG. 3 is a cross-sectional view showing a condition in which the multi-pole sub-connector is incompletely retained on the frame.
Figure 5:
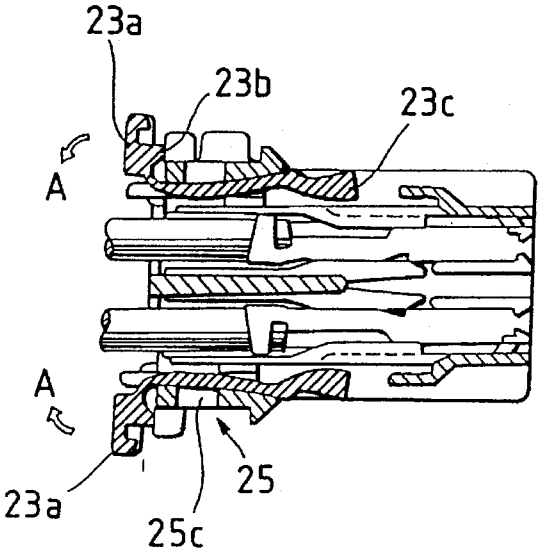
FIG. 5 is a cross-sectional view showing a provisionally-retained condition of female terminals in the multi-pole sub-connector.
Figure 6:
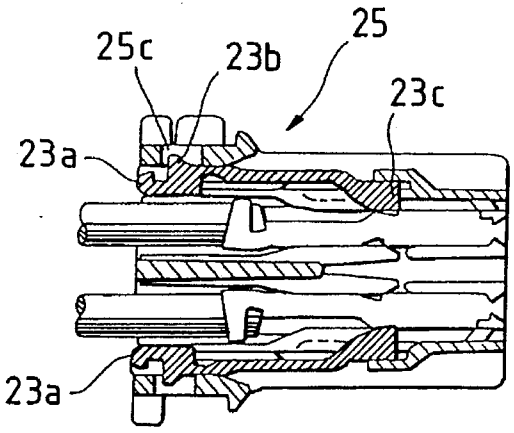
FIG. 6 is a cross-sectional view showing a completely-retained condition of the female terminals in the multi-pole sub-connector.

A preferred embodiment of a divided-type multi-pole connector of the present invention will now be described in detail with reference to FIGS. 1 to 6. FIG. 1 is a perspective view showing an overall construction of the divided-type multi-pole connector, FIG. 2 is a cross-sectional view of an important portion showing a condition in which a frame and a multi-pole sub-connector, constituting a male connector, are retained relative to each other, FIG. 3 is a cross-sectional view of an important portion showing a condition in which the frame and the multi-pole sub-connector are not retained relative to each other, FIG. 4 is an exploded, perspective view showing the construction of the male connector, FIG. 5 is a cross-sectional view showing a provisionally-retained condition of the multi-pole sub-connector, and FIG. 6 is a cross-sectional view showing a completely-retained condition of the multi-pole sub-connector.

The divided-type multi-pole connector 11 (hereinafter referred to merely as "connector") broadly comprises the male connector 13 having a wire harness 12 connected thereto, and a female connector 14 for fitting on the male connector 13. The male connector 13 corresponds to a first connector in the present invention, and the female connector 14 corresponds to a second connector. The female connector 14 is fixedly mounted on a circuit board 15, and male terminals 14a (see FIG. 3) are connected to a circuit pattern formed on the circuit board 15.

A feature of the connector 11 of this embodiment is that the condition of retaining of multi-pole sub-connectors 22*a* and 22*b* relative to a frame 21 can be checked in a provisionally-retained condition in which the male connector 13 is to be fitted in the female connector 14, the frame 21 and the sub-connectors 22*a* and 22*b* constituting the male connector 13. This check is effected by means of provisionally-retaining projections 16, formed on the male connector 13, and provisionally-retaining arms 17 formed on the female connector 14. For description purposes, the construction of the male connector 13 will be first described, and then the retaining of the male connector relative to the female connector 14 will be described.

Figure 4:
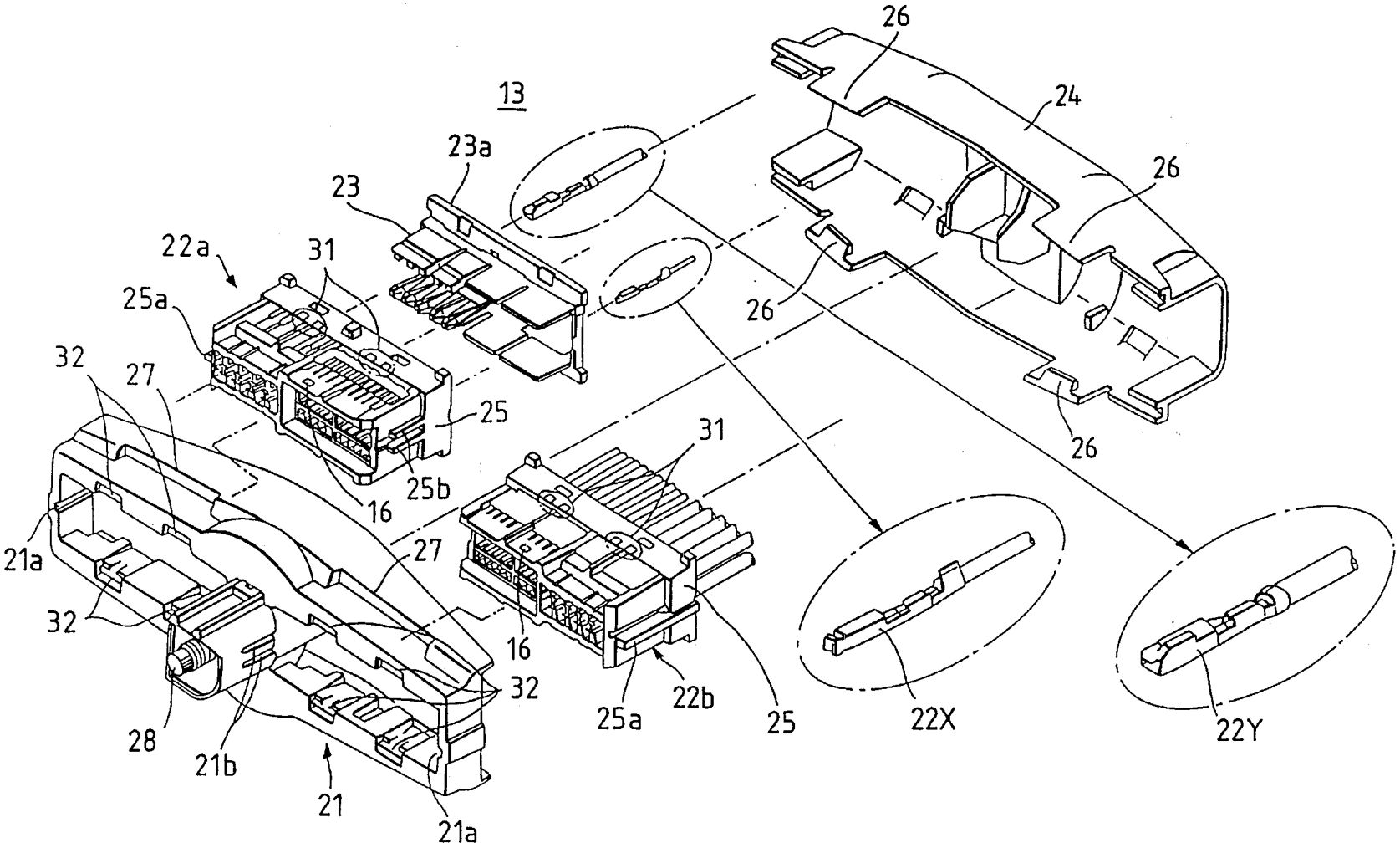
FIG. 4 is an exploded, perspective view showing the construction of a female connector.
Figure 7:
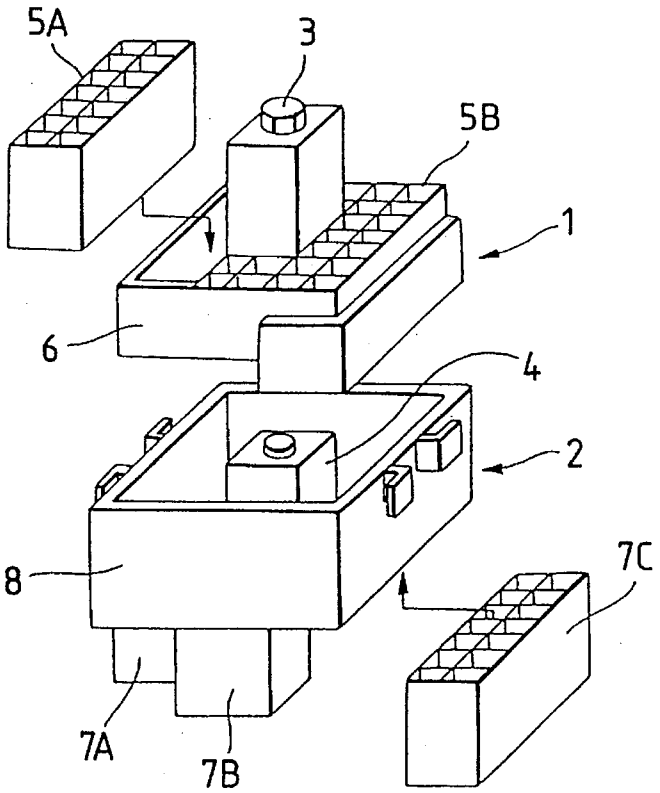
FIG. 7 PRIOR ART
FIG. 7 is a perspective view of a conventional multiple connector.

As shown in FIG. 4, the male connector 13 comprises the frame 21 of a rectangular construction, a plurality of kinds of multi-pole sub-connectors 22*a* and 22*b* fitted in this frame 21, rear holders 23 respectively supporting the sub-connectors from rear sides thereof, and a frame cover 24 covering the multi-pole sub-connectors 22*a* and 22*b* fitted in the frame 21.

The multi-pole sub-connectors 22*a* and 22*b* have female terminals 22*x* and 22*y* (shown on an enlarged scale in FIG. 4) of various shapes inserted in a male housing 25 in insulated relation to one another. Wires, constituting the wire harness 12 shown in FIG. 1, are electrically connected respectively to one ends of the female terminals 22*x* and 22*y*. In FIG. 4, the rear holder for the multi-pole sub-connector 22*b* is completely retained on the male housing 25.

Next, the assembling of the male connector 13 will now be described. The multi-pole sub-connectors 22*a* and 22*b* have the same basic construction, and therefore the assembling process and the operation will be described with respect to the multi-pole sub-connector 22*a*. The rear holder 23 is pre-set on the male housing 25, and the female terminals 22*x* and 22*y* are inserted from the rear side, that is, from left to right in FIG. 5. In this provisionally-retained condition, flanges 23*a* of the rear holder 23 are projected from an outer edge of the male housing 25, as shown in FIG. 5.

However, the rear holder 23 is elastic, and therefore when the rear holder is further forced into the male housing 25 while urging the flanges 23*a* in directions of arrow A (FIG. 5), projections 23*b* formed on the rear holder 23 are retainingly received respectively in recesses 25*c* formed in the inner surface of the male housing 25. As a result, front end portions 23*c* prevent the female terminals 22*x* and 22*y* from withdrawing, as shown in FIG. 6, and the rear holder is thus shifted from the provisionally-retained condition (FIG. 5) to the completely-retained condition, thus providing the multi-pole sub-connector 22*a*.

The thus assembled multi-pole sub-connectors 22*a* and 22*b* are inserted into the frame 21. In this inserting operation, guide projections 25*a* and 25*b*, formed on the outer surface of the male housing 25, are received in respective guide portions 21*a* and 21*b* formed in the inner surface of the frame 21, thereby preventing misregistration and erroneous insertion. If this insertion is effected properly, retaining projections 31, formed on the outer surface of the male housing 25, are retained respectively by frame lances 32 formed on the inner surface of the frame 21, as shown in FIG. 2.

In contrast, if the above insertion is effected incompletely, the retaining projections or retaining members 31 are not retained by the frame lances 32 as shown in FIG. 3, and this incomplete insertion can be positively detected when the male connector is to be fitted into the female connector 14. Then, the frame cover 24 is directed to the rear side of the frame 21, and is attached to this frame. In this attachment operation, four retaining pawls 26, formed on the frame cover 24, are retained respectively by four retaining portions 27 formed on the frame 21. Thus, the multi-pole sub-connectors 22*a* and 22*b* are inserted into the frame 21, and the frame cover 24 covers the frame, thereby completing the assembling of the male connector 13. As a result, the assembling of the male connector 13, having the multi-pole sub-connectors 22*a* and 22*b* inserted in the frame 21 and covered with the frame cover 24, is completed.

Next, the operation for fitting the male connector 13 in the female connector 14 will now be described. The provisionally-retaining projections 16, formed on the outer surface of the male connector 13, are provisionally retained respectively on the provisionally-retaining arms 17 formed on the inner surface of the female connector 14. In this provisionally-retained condition, the two connectors 13 and 14 are held in position in such a manner that they are disposed in parallel, opposed relation to each other so that they can be properly fitted together, and also a bolt 28, projectingly provided at a generally central portion of the male connector 13, is disposed in registry with a threaded hole 29 provided in a generally central portion of the female connector 14, and therefore the two connectors are fitted together by tightening this bolt. The cross-sectional shape of the provisionally-retaining arm 17 is shown in FIG. 3.

When the male connector 13 is to be fitted in the female connector 14 as described above, the following operations to be noted are effected. Namely, when the multi-pole connectors 22*a* and 22*b* are to be inserted into the frame 21, the retaining projections 31 on the male housing 25 may fail to be engaged by the respective frame lances 32 on the frame 21 as shown in FIG. 3, so that the insertion is not effected properly, or is effected incompletely. In such a case, when forcing the male connector 13 into the female connector 14, the front end of the provisionally-retaining arm 17 of the female connector 14 abuts against the provisionally-retaining projection 16 of the male connector 13, thereby exerting a force in a direction (a right-hand direction in FIG. 3)

opposite to the direction of insertion of the multi-pole sub-connectors 22*a* and 22*b*.

As a result, the rear end portions of the multi-pole sub-connectors 22*a* and 22*b* are projected from a rear side 33 of the frame 21, and therefore the non-insertion is detected. In contrast, if the multi-pole sub-connectors 22*a* and 22*b* are properly retained on the frame 21, the engagement of the multi-pole sub-connectors 22*a* and 22*b* with the frame 21 is not released even if the provisionally-retaining arms 17 are disposed in the provisionally-retained condition to engage the respective provisionally-retaining projections 16, and each provisionally-retaining arm 17 slides over the associated provisionally-retaining projection 16, thus enabling the two connectors 13 and 14 to be fitted together. Therefore, the multi-pole sub-connectors 22*a* and 22*b* will not be withdrawn rearwardly, and the insertion of the multi-pole sub-connectors 22*a* and 22*b* is checked.

Namely, the retaining force between the retaining projections 31 of the multi-pole sub-connectors 22*a* and 22*b* and the frame lances 32 of the frame 21 is greater than the provisionally-retaining, inserting force between the provisionally-retaining projections 16 of the male connector 13 and the provisionally-retaining arms 17 of the female connector 14. Also, the frictional force, obtained when the multi-pole sub-connectors 22*a* and 22*b* are not completely attached to the frame 21 as shown in FIG. 3, is smaller than the provisionally-retaining, inserting force between the female connector 14 and the male connector 13.

Therefore, if the multi-pole sub-connectors 22*a* and 22*b* are properly retained relative to the frame 21, the male connector 13 can be fitted in the female connector 14. If the multi-pole sub-connectors 22*a* and 22*b* are not properly retained, these sub-connectors are forced out of the frame 21, thereby enabling the improper retaining to be detected, and therefore the male connector suffering from such improper retaining is prevented from being connected to the female connector 14.

As described above, in the divided-type multi-pole connector of the present invention, the plurality of kinds of multi-pole sub-connectors are provided with the retaining means for retaining them on the frame, and the provisionally-retaining projections. If an erroneous insertion is not encountered, the multi-pole sub-connectors are fitted in the frame, and are retained relative thereto, and thus are integrally connected together to provide the first connector. The second connector (i.e.,the mating connector) to be connected to the first connector of the above construction is provided with the provisionally-retaining arms each of which forces a corresponding one of the multi-pole sub-connectors from the frame if this corresponding sub-connector is incompletely retained on the frame.

Therefore, if an improper retaining condition is encountered in the first connector, this improper retaining can be positively detected, and the first connector, suffering form such improper retaining, is prevented from being connected to the second connector.

What is claimed is:

1. A divided-type multi-pole electrical connector comprising:

a first electrical connector including:

a frame having a plurality of lances and a plurality of multi-pole sub-connectors fitted in the frame, each of the multi-pole sub-connectors having a retaining member and a provisionally retaining projection, wherein each said retaining member engages with an associated one of said lances when the sub-connectors are inserted into the frame in a first direction to a completely inserted position; and a second electrical connector having a provisionally-retaining arm for each said provisionally retaining projection, each said provisionally-retaining arm abutting against each said provisionally retaining projection when said first connector is fitted in said second connector;

wherein each said provisionally-retaining arm slides over the associated provisionally retaining projection when the sub-connectors are in said completely inserted position, and wherein each said provisionally-retaining arm forces the associated provisionally retaining projection in a second direction opposite to the first direction so as to force sub-connectors at least partially out of the frame when the sub-connectors are not in said completely inserted position.

2. A divided-type multi-pole electrical connector housing as claimed in claim 1, further comprising:

a rear holder for retaining a terminal in the first connector, the rear holder inserted into the first connector and positioned in one of a provisionally retained-condition and a completely-retained condition.

3. A divided-type multi pole electrical connector housing as claimed in claim 1, wherein the multi-pole sub-connector is provided with a guide projection, and the frame is provided with a guide recess engaged with the guide projection.

4. A divided-type multi-pole electrical connector as claimed in claim 1, wherein an engagement force between each said retaining member and the associated lance is greater than an inserting force which causes each said provisionally-retaining arm to slide over each said provisionally retaining projection.

* * * * *